US008297927B1

(12) United States Patent
Liang

(10) Patent No.: US 8,297,927 B1
(45) Date of Patent: Oct. 30, 2012

(54) NEAR WALL MULTIPLE IMPINGEMENT SERPENTINE FLOW COOLED AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1188 days.

(21) Appl. No.: 12/041,828

(22) Filed: Mar. 4, 2008

(51) Int. Cl.
*F01D 5/18* (2006.01)

(52) U.S. Cl. ..... 416/97 R

(58) Field of Classification Search ..... 415/115, 415/116; 416/90 R, 96 R, 97 R
See application file for complete search history.

(56) References Cited

U.S. PATENT DOCUMENTS 2,843,354 A * 7/1958 Smith ..... 416/97 R
4,514,144 A * 4/1985 Lee ..... 416/96 R
5,484,258 A * 1/1996 Isburgh et al. ..... 415/115
5,667,359 A * 9/1997 Huber et al. ..... 416/96 A
5,993,156 A * 11/1999 Bailly et al. ..... 416/96 A
6,264,428 B1 * 7/2001 Dailey et al. ..... 416/97 R
6,705,836 B2 * 3/2004 Bourriaud et al. ..... 416/97 R
2006/0239820 A1 * 10/2006 Kizuka et al. ..... 416/97 R
2009/0232661 A1 * 9/2009 Ryznic ..... 416/97 R

* cited by examiner

*Primary Examiner* — Richard Edgar
*Assistant Examiner* — Ryan Ellis
(74) *Attorney, Agent, or Firm* — John Ryznic

(57) ABSTRACT

A turbine airfoil with pressure and suction side walls having a series of radial extending multiple impingement cooling channels in which each channel is formed with a series of impingement chambers and impingement holes that discharge impingement cooling air against the backside walls of the airfoil. The spent impingement cooling air from the radial impingement channels is discharged into collector cavities and then discharge as film cooling air onto the external surface of the airfoil.

17 Claims, 3 Drawing Sheets

NEAR WALL MULTIPLE IMPINGEMENT SERPENTINE FLOW COOLED AIRFOIL

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to cooling of a turbine airfoil exposed to a high firing temperature.

2. Description of the Related Art Including Information Disclosed Under 37 CFR 1.97 and 1.98

In a gas turbine engine, a hot gas flow is passed through a turbine to extract mechanical energy used to drive the compressor or a bypass fan. The turbine typically includes a number of stages to gradually reduce the temperature and the pressure of the flow passing through. One way of increasing the efficiency of the engine is to increase the temperature of the gas flow entering the turbine. However, the highest temperature allowable is dependent upon the material characteristics and the cooling capabilities of the airfoils, especially the first stage stator vanes and rotor blades. Providing for higher temperature resistant materials or improved airfoil cooling will allow for higher turbine inlet temperatures.

Another way of increasing the engine efficiency is to make better use of the cooling air used to cool the airfoils. A typical air cooled airfoil uses compressed air that is bled off from the compressor. Since this bleed off air is not used for power production, airfoil designers try to minimize the amount of bleed off air used for the airfoil cooling while maximizing the amount of cooling by the bleed off air.

In the industrial gas turbine engine (IGT), high-turbine inlet temperatures are envisioned while using low cooling flows. The low cooling flows pass the compressed cooling air through the airfoils without discharging film cooling air out through the airfoil surface and into the hot gas flow. Thus, there is a need for an improvement in the design of low flow cooling circuits for airfoils exposed to higher gas flow temperatures.

BRIEF SUMMARY OF THE INVENTION

It is an object of the present invention to provide for an air cooled turbine airfoil that operates at high firing temperature and with low cooling flow.

Another object of the present invention to provide for an air cooled turbine airfoil in which individual impingement cooling circuits can be independently designed based on the local heat load and aerodynamic pressure loading conditions around the airfoil.

Another object of the present invention to provide for an air cooled turbine airfoil with multiple use of the cooling air to provide higher overall cooling effectiveness levels.

Another object of the present invention to provide for an air cooled turbine airfoil having a relatively thick TBC with a very effective cooling design.

Another object of the present invention to provide for an air cooled turbine airfoil with a suction side cooling flow circuit from the pressure side flow circuit in order to eliminate the airfoil mid-chord cooling flow mal-distribution due to mainstream pressure variation.

Another object of the present invention to provide for an air cooled turbine airfoil with near wall cooling that allows for well defined film cooling holes on the airfoil wall surface.

A turbine airfoil, such as a stator vane or a rotor blade, with a pressure side wall and a suction side wall extending between a leading edge and a trailing edge of the airfoil. The side walls include a plurality of adjacent radial extending channels each having a series of impingement holes formed in angles ribs that extend in the radial direction of the channel to form a multiple impingement cooling channel along the airfoil wall. Three adjacent channels form a serpentine flow cooling passage to channel cooling air along the serpentine channels to produce multiple, impingement cooling. A number of these multiple impingement serpentine cooling channels are formed along the sidewalls of the airfoil that each discharge into inner collection chambers of the airfoil. Film cooling holes and exit cooling holes discharge the spent cooling air from the collection chambers out from the airfoil to provide film cooling. A leading edge impingement chamber is connected to the forward-most inner collection chamber and discharges film cooling air through a showerhead arrangement for leading edge cooling. Near wall cooling of the airfoil is produced using a low flow cooling volume

DETAILED DESCRIPTION OF THE INVENTION

The present invention is a near wall multiple impingement serpentine flow cooling circuit used in a stator vane of a gas turbine engine. However, the cooling circuit could also be used in a rotor blade of the engine. The cooling circuit of the present invention is shown in the cross section view of the vane in FIG. 1 and includes five serpentine cooling circuits (A through E) each having the multiple impingement cooling channels of the present invention.

Figure 3:
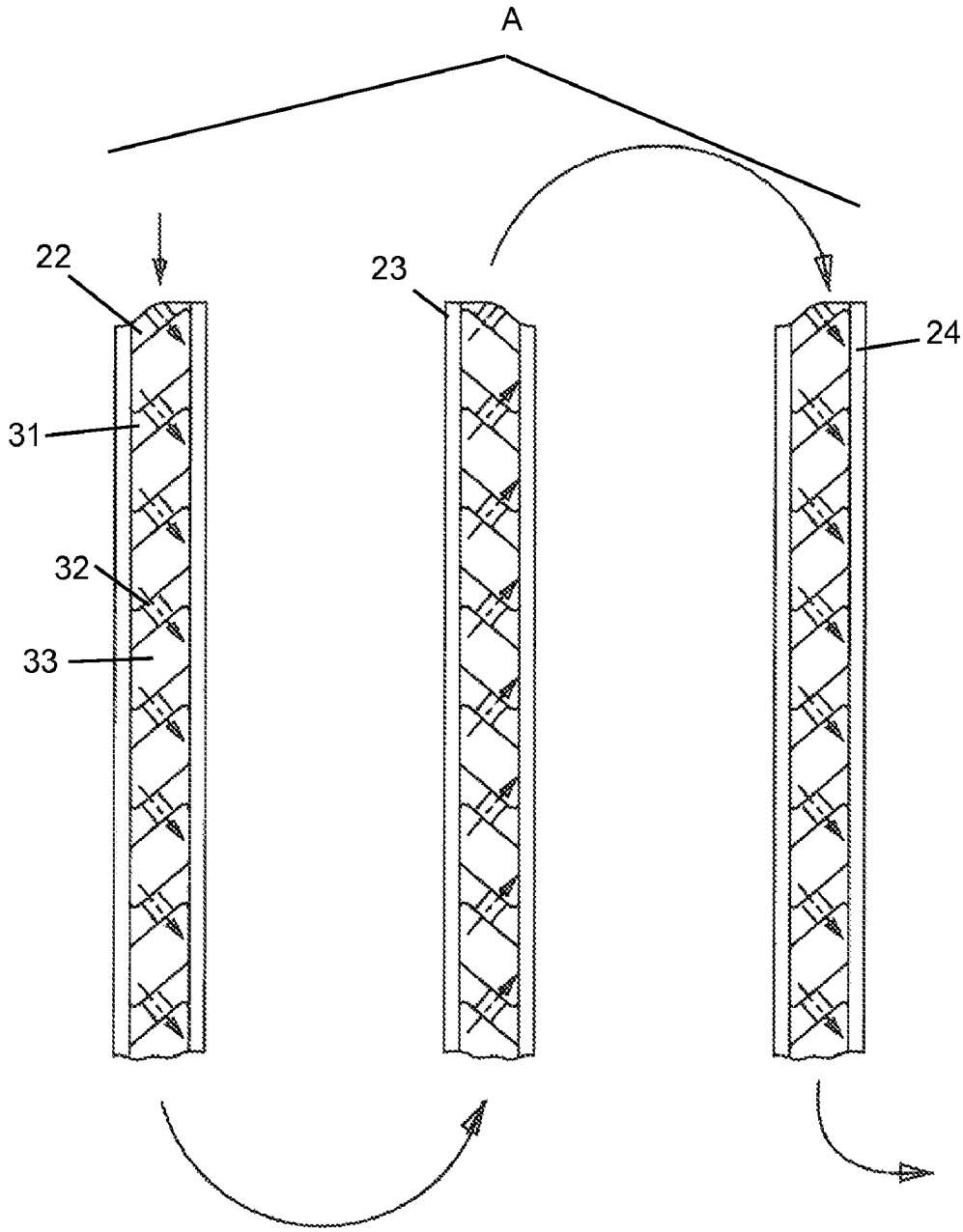
FIG. 3 shows a cross section side view of the details of one of the serpentine flow multiple impingement channels of the present invention.

The serpentine cooling circuits are formed from a series of adjacent radial extending channels formed in the airfoil walls on the pressure side and the suction side of the airfoil. FIG. 3 shows one of the multiple impingement serpentine flow circuits having three channels each with a series of impingement holes extending along the channel. The first channel 22 includes a number of impingement holes 32 formed in a slanted wall 31 which forms impingement chambers 33. The slanted walls 31 are so oriented within the channel 22 to direct the impingement cooling air against the inner surface of the wall exposed to the hot gas flow. As seen in FIG. 3, the spent cooling air from the first channel 22 flows into the inlet of the second channel 23 where another series of impingement cooling holes are arranged. The spent cooling air from the second channel 23 flows into the third channel 24 which also has a series of impingement cooling holes to provide cooling to the hot wall surface of the third channel.

Figure 1:
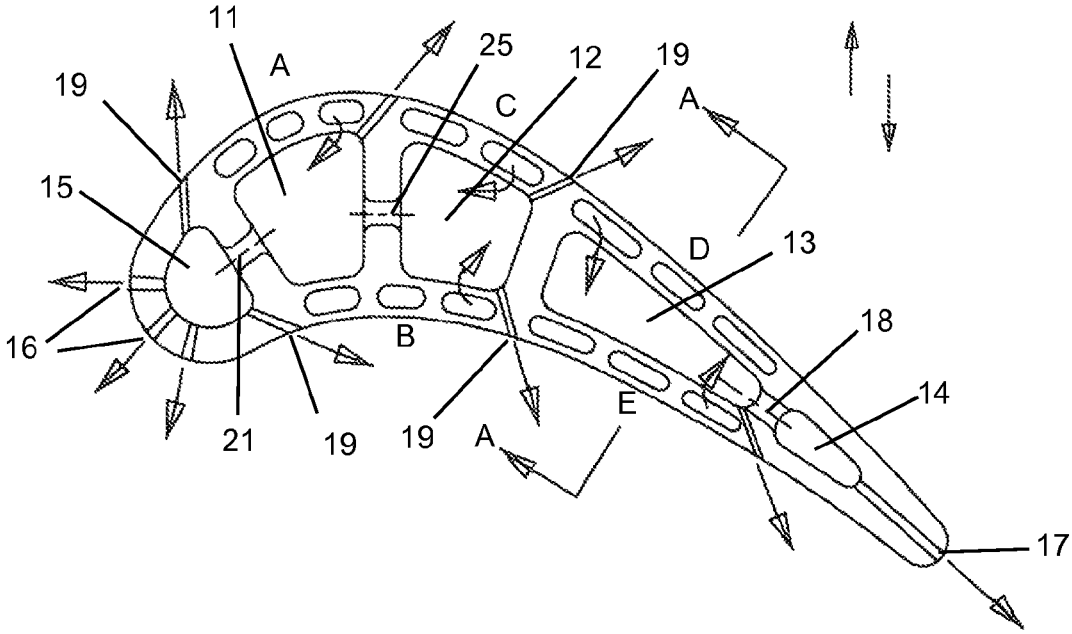
FIG. 1. shows a cross section top view of the multiple serpentine with multiple impingement cooling circuit in a turbine vane of the present invention.

As seen in FIG. 1, the plurality of serpentine cooling channels is spaced along the airfoil walls on the pressure and suction sides. Ribs extend from the walls to separate the inner portions of the airfoil into a forward inner collection chamber 11, a middle inner collection chamber 12 and an aft inner collection chamber 13. A series of metering holes 25 connects the forward inner collection chamber 11 to the middle inner collection chamber 12. Film cooling holes 19 connect the inner collection chambers to the pressure side or the suction side walls to discharge film cooling air to required wall surfaces.

A leading edge impingement channel 15 is connected to the forward inner collection chamber 11 through a series of metering and impingement holes 21. A showerhead arrangement of film cooling holes 16 is connected to the leading edge impingement channel 15 along with optional pressure and suction side gill holes 19. Cooling air is supplied to the leading edge impingement channel 15 from the forward inner collection chamber 11 through the metering and impingement holes 21.

The trailing edge region of the airfoil includes a series of metering and impingement holes 18 connected to the aft inner collection chamber 13, trailing edge impingement chambers 14 connected in series with the impingement holes 18 and a row of exit cooling holes 17 connected to the impingement chambers 14.

Figure 2:
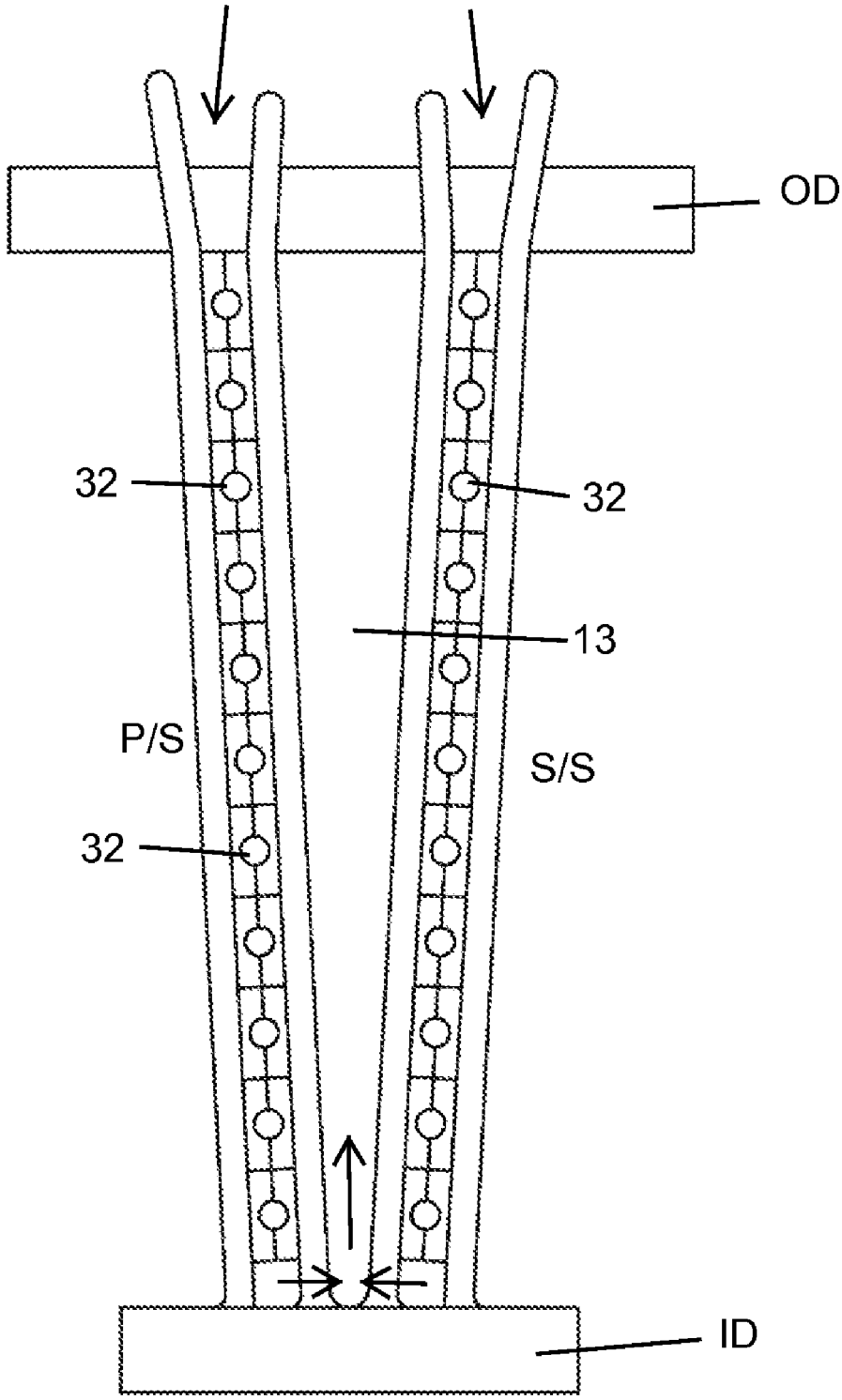
FIG. 2 shows a cross section view of the turbine vane through the line A-A of FIG. 1.

FIG. 2 shows a cross section view through the rear side of the airfoil through the line A-A of FIG. 1. The pressure side (PS) and the suction side (SS) of the airfoil are labeled in FIG. 2 with the pressure side wall on the left and the suction side wall on the right. The inner collection chamber 13 is located between the two walls. The impingement holes 32 are shown extending from the outer diameter (OD) platform to the inner diameter (ID) platform of the stator vane. The cooling air enters the serpentine channels from the top or (OD) end and flows down toward the (ID). In the 3-pass serpentine flow circuits, the spent cooling air from the third leg or channel flows into the inner collection chamber from the bottom of the channel at the (ID) end as seen by the arrows in FIG. 2.

The operation of the cooling circuit of the present invention will now be described. Pressurized cooling air from an external source (such as the compressor) is supplied to the inlet of the first channel in the serpentine cooling circuits A through E of the airfoil shown in FIG. 1. Serpentine flow circuits A, B, D and E are 3-pass serpentines while circuit C is a 2-pass serpentine circuit because of the short space in the wall between serpentines A and D. Cooling air flows into the first leg or channel of the serpentine circuit in a downward direction toward the (ID) end and through the series of impingement holes 25. In FIG. 3, a 3-pass serpentine circuit is shown in which the first leg 22 is on the left side, the second leg 23 is in the middle and the third and last leg 24 is on the right side. The cooling air flows through the first leg and then turns upward and into the second leg 23, and then flows through a similar series of impingement holes 32 toward the (OD) end. The cooling air flows out the second leg 23 and turns into the inlet of the third leg 24, where the cooling air flows toward the (ID) and through another series of impingement holes. On the third and last leg 24 of the serpentine circuit, the spent cooling air is discharged into the associated inner collection chamber 13 as seen in FIG. 2. From the inner collection chambers, the spent cooling air is then discharged through one or more rows of film cooling holes onto the pressure or the suction side walls of the airfoil. Or, in the case of the aft inner collection chamber, the spent cooling air is also discharged out through the trailing edge exit holes 17. The spent cooling air discharged into the forward inner collection chamber 11 can flow through the leading edge metering and impingement holes 21 and into the leading edge impingement channel 15, or through the metering holes 25 and into the mid inner collection chamber 12, or out through the suction side film cooling holes 19 just downstream from the serpentine circuit A.

The serpentine circuit (B) is similar to the serpentine circuit (A) with three channels each with multiple impingement holes as seen in FIG. 3. The cooling air supplied to the circuits (A, B, C, D and E) enters at the (OD) end, flows through three channels, and then discharges into an associated inner collection chamber at the (ID) end. Serpentine circuit (C), because of the short chord-wise distance, has only two channels and therefore discharges into the mid inner collection chamber at the (OD) end. However, the principal is still the same. The cooling air flows only through two channels as represented by channels 22 and 23 in FIG. 3 before discharging into the collection chamber at the (OD) end.

Thus, in the serpentine flow cooling channels with the multiple impingement holes of the present invention, cooling air is fed from the (OD) cooling supply plenum, flows downward through the near wall multiple impingement serpentine cooling channel to provide convective cooling first. In each individual impingement cavity within the channel, the slanted impingement rib and the impingement cooling hole will direct the cooling air onto the backside of the airfoil inner wall. The lower corner of the impingement cavity functions as the cooling supply cavity for the downstream impingement supply cooling cavity. The impingement cooling process repeats through the entire radial flow channel to the vane (ID) location or end. This cooling circuit can be designed as a 2-pass, 3-pass, 4-pass or 5-pass serpentine flow channels depending on the number of multiple pass flow channels used in the cooling design.

The spent cooling air form the serpentine flow channel is discharged into the inner main body collection chambers. This spent cooling air is then impinged onto the inner surface of the blade leading edge wall to provide blade leading edge backside impingement cooling. In addition, film cooling holes can be incorporated into the forward cooling system by bleeding off spent cooling air from either the leading edge impingement cavity or the airfoil main body collection chambers. A similar cooling flow arrangement is used for the airfoil aft cooling flow circuits, cooling air is fed from the (OD) cooling supply plenum, flows downward through the multiple impingement serpentine cooling flow channel first, and then discharges into the inner body collection chamber. The spent cooling air is then impinged onto the airfoil trailing edge impingement cavity prior to discharging from the trailing edge impingement cavity through the series of exit cooling holes.

Major design advantages of the cooling circuit of the present invention over the prior art serpentine cooled airfoil design is described below. 1) Each individual impingement cooling circuit can be independently designed based on the local heat load and aerodynamic pressure loading conditions. When multiple impingement serpentine flow circuits are used for the entire airfoil, more effective use of cooling air and a more uniform blade metal temperature is possible. 2) Multiple impingement cooling utilizes the same amount of cooling air which yields a higher level of backside impingement heat transfer coefficient and cooler airfoil metal temperature. 3) Multiple use of cooling air provides for a higher overall cooling effectiveness level. 4) The combination of serpentine cooling with multiple impingement cooling achieves a much higher cooling level for a given flow rate. 5) The multiple impingement cooling concepts increases the design flexibility to metering cooling flow to each section of the airfoil and therefore increases the growth potential for the cooling design when larger airfoils are used. 6) Since all cooling air is metered through the series of multiple impingement holes as well as the leading edge and the trailing edge impingement holes, the series of multiple impingement cooling holes design yields an excellent cooling flow control mechanism. 7) Near wall multiple impingement cooling utilized for the airfoil main body reduces external wall thickness, increases overall conduction to the inner wall, and increases airfoil overall heat transfer convection capability to yield a very effective cooling design, especially for an airfoil coated with a thick thermal barrier coating. 8) Pressure side flow circuits are separated from suction side flow circuits and therefore eliminate the airfoil mid-chord cooling flow mal-distribution due to mainstream pressure variation. 9) The counter flow cooling design utilized for the entire airfoil improves the airfoil TMF (thermal metal fatigue) capability. The cooling air provides cooling for the airfoil wall first and the warm air is then discharged into the main body inner cavities. This warm air heats up the inner walls for the multiple impingement channels and thus reduces the thermal gradient across the airfoil wall. 10) The counter flow cooling technique utilized for the entire airfoil increases the efficiency for the use of cooling air. The cooling air provides cooling for the airfoil wall first and then discharges into the main stream as film cooling from the inner body collection chambers. 11) Film cooling holes can be installed in between the multiple impingement channel through the airfoil wall which increase the film hole length and yields a well defined film cooling hole geometry. This is totally different from the prior art near wall cooling design where the film hole is bled off from the near wall cooling channel. Especially for the thin outer wall, a well defined film cooling hole is very difficult to obtain.

I claim the following:

1. An air cooled turbine airfoil comprising:

an airfoil wall having a hot gas flow side and an internal cooling air chamber side opposite to the hot gas flow side;

a first radial extending channel formed within the airfoil wall, the first radial extending channel having formed therein a series of impingement holes and impingement chambers extending along the channel;

a second radial extending channel formed within the airfoil wall and adjacent to the first radial extending channel, the second radial extending channel having formed therein a series of impingement holes and impingement chambers extending along the channel; and, the first radial extending channel being connected to the second radial extending channel such that cooling air from the first radial extending channel flows into the second radial extending channel.

2. The air cooled turbine airfoil of claim 1, and further comprising:

the impingement holes are formed in slanted ribs that define the impingement chambers.

3. The air cooled turbine airfoil of claim 2, and further comprising:

the ribs are slanted toward the hot gas side of the airfoil wall.

4. The air cooled turbine airfoil of claim 3, and further comprising:

the impingement holes are positioned within the ribs such that the impingement cooling air is directed against a backside surface of the airfoil wall exposed to the hot gas flow.

5. The air cooled turbine airfoil of claim 1, and further comprising:

a third radial extending channel formed within the airfoil wall and adjacent to the second radial extending channel, the third radial extending channel having formed therein a series of impingement holes and impingement chambers extending along the channel; and, an outlet of the second radial channel is connected to an inlet of the third radial channel.

6. The air cooled turbine airfoil of claim 5, and further comprising:

a spent air collection chamber formed within the airfoil and located inward from the third radial extending channel; and, an outlet of the third radial channel is connected to the spent air collection chamber.

7. The air cooled turbine airfoil of claim 6, and further comprising:

a film cooling hole extending through the airfoil wall and being connected to the spent air collection chamber.

8. An air cooled turbine stator vane comprising:

an airfoil extending from an inner diameter endwall and an outer diameter endwall;

an inner collection chamber formed between a pressure side airfoil wall and a suction side airfoil wall;

a pressure side serpentine flow cooling circuit formed within the airfoil wall of the pressure side, the pressure side serpentine flow cooling circuit including a plurality of channels each having formed therein a series of impingement holes and impingement chambers to form a series of impingement cooling along the channels;

a suction side serpentine flow cooling circuit formed within the airfoil wall of the suction side, the suction side serpentine flow cooling circuit including a plurality of channels each having formed therein a series of impingement holes and impingement chambers to form a series of impingement cooling along the channels; and, an outlet of the last channel in the pressure side serpentine flow cooling circuit and the suction side serpentine flow cooling circuit is connected to the inner collection chamber.

9. The air cooled turbine stator vane of claim 8, and further comprising:

the impingement holes are formed in slanted ribs that define the impingement chambers.

10. The air cooled turbine stator vane of claim 9, and further comprising:

the ribs are slanted toward a hot gas side of the airfoil wall.

11. The air cooled turbine stator vane of claim 10, and further comprising:

the impingement holes are positioned within the ribs such that the impingement cooling air is directed against a backside surface of the airfoil wall exposed to a hot gas flow.

12. The air cooled turbine stator vane of claim 8, and further comprising:

the pressure side serpentine flow cooling circuit and the suction side serpentine flow cooling circuit are both 3-pass serpentine circuits in which the inlets are adjacent to the OD endwall and the outlets are adjacent to the ID endwall.

13. The air cooled turbine stator vane of claim 12, and further comprising:

the suction side serpentine flow cooling circuit discharges into a first inner collection chamber; and, the pressure side serpentine flow cooling circuit discharges into a second inner collection chamber located aft of the first inner collection chamber.

14. The air cooled turbine stator vane of claim 8, and further comprising:

a second pressure side serpentine flow cooling circuit formed in the airfoil wall in a trailing edge region of the airfoil;

a second suction side serpentine flow cooling circuit formed in the airfoil wall in the trailing edge region of the airfoil;

an aft inner collection chamber formed between the pressure side wall and the suction side wall in the trailing edge region of the airfoil;

the second pressure and suction side serpentine flow cooling circuits both including a plurality of channels each having formed therein a series of impingement holes and impingement chambers to form a series of impingement cooling along the channel;

the outlets of the second pressure and suction side serpentine flow cooling circuits being connected to the aft inner collection chamber; and, a row of exit cooling holes located within the trailing edge of the airfoil and connected to the aft inner collection chamber.

15. The air cooled turbine stator vane of claim 14, and further comprising:

the inner collection chambers each being connected to a row of film cooling holes to discharge film cooling air onto the pressure side wall or the suction side wall.

16. The air cooled turbine stator vane of claim 8, and further comprising:

a leading edge impingement channel;

a metering and impingement hole connecting the inner collection chamber to the leading edge impingement channel; and, a showerhead arrangement of film cooling holes connected to the leading edge impingement channel to discharge film cooling air onto the leading edge of the airfoil from the inner collection chamber.

17. An air cooled turbine stator vane comprising:

a leading edge region and a trailing edge region;

a pressure side wall and a suction side wall extending between the leading edge region and the trailing edge region;

a plurality of ribs extending from the pressure side wall to the suction side wall and forming a leading edge impingement chamber, a forward collection chamber, a middle collection chamber and an aft collection chamber;

a first serpentine flow cooling circuit formed in the suction side wall in which each leg of the serpentine forms a series of impingement holes and impingement chambers to provide impingement cooling to the suction side wall;

a second serpentine flow cooling circuit formed in the pressure side wall in which each leg of the serpentine forms a series of impingement holes and impingement chambers to provide impingement cooling to the pressure side wall;

the first serpentine flow cooling circuit having a last leg that discharges into the forward collection chamber;

the second serpentine flow cooling circuit having a last leg that discharges into the middle collection chamber;

a third serpentine flow cooling circuit formed in the suction side wall in which each leg of the serpentine forms a series of impingement holes and impingement chambers to provide impingement cooling to the suction side wall;

a fourth serpentine flow cooling circuit formed in the pressure side wall in which each leg of the serpentine forms a series of impingement holes and impingement chambers to provide impingement cooling to the pressure side wall;

the third and the fourth serpentine flow cooling circuits each having a last leg that discharges into the aft collection chamber;

the forward and the middle collection chambers each being connected to a row of film cooling holes; and, the aft collection chamber connected to a row of trailing edge exit holes.

* * * * *